US005947603A

United States Patent [19]

Tilman

[11] Patent Number: 5,947,603

[45] Date of Patent: Sep. 7, 1999

[54] RESEALABLE CLOSURE MECHANISM HAVING A SLIDER DEVICE AND SEPARATE HOUSING

[75] Inventor: Paul A. Tilman, Sherwood, Wis.

[73] Assignee: Reynolds Consumer Products, Inc., Appleton, Wis.

[21] Appl. No.: 09/129,046

[22] Filed: Aug. 4, 1998

[51] Int. Cl.[6] ..... B65D 33/25

[52] U.S. Cl. ..... 383/64; 24/427; 493/213; 493/214

[58] Field of Search ..... 383/64; 24/416, 24/417, 427, 428, 399, 400; 493/212, 213, 214

[56] References Cited

U.S. PATENT DOCUMENTS

| | | | |
|---|---|---|---|
| 3,122,807 | 3/1964 | Ausnit | 383/64 |
| 3,426,396 | 2/1969 | LaGuerre | 383/64 |
| 3,579,747 | 5/1971 | Hawley | 24/201 |
| 3,660,875 | 5/1972 | Gutman | 24/201 |
| 3,959,856 | 6/1976 | Ausnit | 24/201 |
| 5,007,142 | 4/1991 | Herrington | 24/400 |
| 5,007,143 | 4/1991 | Herrington | 24/400 |
| 5,010,627 | 4/1991 | Herrington et al. | 24/400 |
| 5,020,194 | 6/1991 | Herrington et al. | 24/400 |
| 5,063,644 | 11/1991 | Herrington et al. | 24/400 |
| 5,067,208 | 11/1991 | Herrington, Jr. et al. | 24/400 |
| 5,070,583 | 12/1991 | Herrington | 24/400 |
| 5,088,971 | 2/1992 | Herrington | 493/203 |
| 5,131,121 | 7/1992 | Herrington, Jr. et al. | 24/436 |
| 5,189,764 | 3/1993 | Herrington et al. | 24/387 |
| 5,283,932 | 2/1994 | Richardson et al. | 24/400 |
| 5,301,394 | 4/1994 | Richardson et al. | 24/399 |
| 5,301,395 | 4/1994 | Richardson et al. | 24/400 |
| 5,426,830 | 6/1995 | Richardson et al. | 24/430 |
| 5,431,760 | 7/1995 | Donovan | 156/66 |
| 5,442,837 | 8/1995 | Morgan | 24/400 |
| 5,827,163 | 10/1998 | Kettner | 493/213 |
| 5,836,056 | 11/1998 | Porchia et al. | 24/400 |

FOREIGN PATENT DOCUMENTS

| | | | |
|---|---|---|---|
| WO 92/17085 | 10/1992 | European Pat. Off. | A44B 19/16 |
| WO 92/17086 | 10/1992 | European Pat. Off. | A44B 19/16 |
| WO 92/17087 | 10/1992 | European Pat. Off. | A44B 19/16 |

*Primary Examiner*—Stephen P. Garbe
*Attorney, Agent, or Firm*—Alan M. Biddison

[57] ABSTRACT

A closure arrangement includes a first closure profile, a second closure profile, a slider device, and a slider housing. The slider device is designed to open the package when slid in one direction and to seal the package when slid in the opposite direction. The slider housing extends from a side of the package. The slider housing is designed to receive the slider device. When the package is opened and the slider device is slid into the slider housing, access to the contents of the package is provided across the entire width of the mouth of the package.

27 Claims, 5 Drawing Sheets

RESEALABLE CLOSURE MECHANISM HAVING A SLIDER DEVICE AND SEPARATE HOUSING

FIELD OF THE INVENTION

The present invention generally relates to closure arrangements for polymer packages, for example, plastic bags. In particular, the present invention relates to resealable closure mechanisms or zipper-type closures for resealable packages.

BACKGROUND

Many packaging applications use resealable containers to store various types of articles and materials. These packages may be used to store and ship food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. As such, providing products in resealable packages appreciably enhances the marketability of those products.

Some types of resealable packages are opened and closed using a slider device. The slider device design includes a separator or plow-type structure at one end that opens a closure mechanism, having profiled elements or closure profiles, when the slider device travels in a first direction along the mechanism. The side walls of the slider device are inwardly tapered from one end to the opposite end so that the sidewalls engage the closure profiles and progressively move them into engagement to close the resealable package when the slider device is moved along the closure mechanism in a direction opposite the first direction. Side seals at each end of the closure mechanism keep the slider device from sliding off the package in either direction.

Concerns are raised regarding resealable closure mechanisms with slider devices. One such concern is that the mouth opening is partially blocked by the slider device. The ends of the package are sealed to keep the slider device from sliding off of the profiles; however, this also partially blocks the mouth of the package with the slider device.

SUMMARY OF THE INVENTION

In one aspect of the present invention, one example embodiment involves a closure arrangement for use with a package having a plurality of edges. The closure arrangement includes first and second closure profiles, each having a base strip and an interlocking closure member. The first and second interlocking closure members are arranged and configured to selectively engage. The closure arrangement further includes a slider device having a plow and first and second walls that define a first cavity for receiving the first and second closure profiles. The slider device is arranged and configured to slide along the first and second closure profiles in a first direction to cause the first and second closure profiles to engage and to slide along the first and second closure profiles in a second direction to cause the first and second closure profiles to disengage. The closure arrangement further includes a slider housing that extends beyond one of the plurality of edges of the package and is adapted to receive the slider device.

In another embodiment of the present invention, a resealable package includes first and second panel sections joined together to define an enclosed region, first and second opposite side edges, a top edge, and a mouth that provides access to the enclosed region. The resealable package also includes a closure arrangement for selectively opening and sealing the mouth. The closure arrangement includes structure as previously described herein.

In yet another embodiment of the present invention, a method of manufacturing a resealable package having first and second opposing panel sections is provided. The method includes the steps of placing the first panel section adjacent to the second panel section; placing a closure arrangement between an unsealed edge of the first panel section and a corresponding unsealed edge of the second panel section, the closure arrangement extending between a first side edge of the package and a second side edge of the package; sealing a plurality of edges of the first panel section to corresponding edges of the second panel section; and securing the closure arrangement to the first and second panel sections. The closure arrangement includes structure as previously described herein.

In yet another embodiment of the present invention, a method of opening a resealable package includes the steps of providing a package having first and second opposite side edges, a resealable mouth between the first and second side edges, a resealable closure mechanism and a slider device thereover for opening and resealing the mouth, and a slider housing adapted for receiving the slider device; moving the slider device along the mouth from the second edge to the first edge to disengage the first and second profiles; and moving the slider device into the slider housing providing access across the entire mouth of the package.

The above summary of principles of the present invention is not intended to describe each illustrated embodiment or every implementation of the present invention. The figures and the detailed description that follow more particularly exemplify these embodiments.

BRIEF DESCRIPTION OF THE DRAWINGS

Principles of the invention may be more completely understood in consideration of the detailed description of various embodiments of the invention that follows in connection with the accompanying drawings in which.

Figure 1:
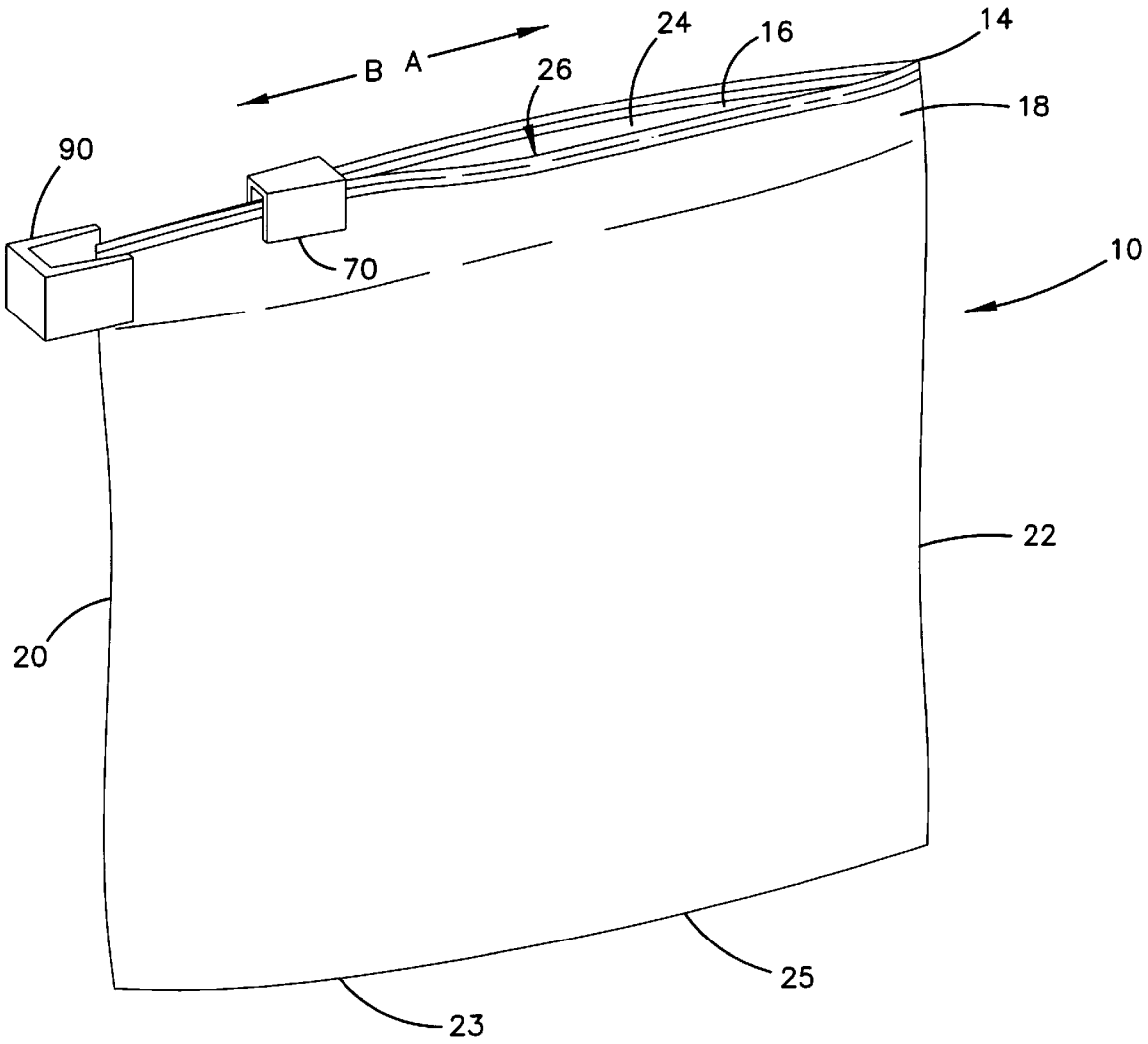
FIG. 1 is a perspective view of a flexible, resealable package, according to an example embodiment of the present invention.

While principles of the invention are amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the disclosure.

DETAILED DESCRIPTION

The present invention is believed to be applicable to a variety of packaging arrangements. The invention has been found to be particularly advantageous for manufacturing resealable closure mechanisms having profiled elements or closure profiles. An appreciation of various aspects of the invention is best gained through a discussion of an application example for such a packaging arrangement.

According to an example embodiment of the present invention, a separate slider housing is provided on a side of a package. This arrangement allows complete access through the mouth of the package. FIG. 1 illustrates an example type of package 10 that benefits from the use of the separate slider housing.

Attention is directed to FIG. 1. FIG. 1 illustrates an example packaging arrangement in the form of a resealable, flexible package 10, for example, a polymer package such as a plastic package, having a resealable closure mechanism 14, for example, profiled elements, constructed in accordance with the present invention. The flexible package 10 includes first and second opposed panel sections 16, 18, typically made from a flexible, polymeric, plastic film. For some manufacturing applications, the first and second panel sections 16, 18 are heat-sealed together along two side edges 20, 22 and meet at a fold line 23 in order to form a three-edged containment section for a product within an interior 24 of the package 10. In the embodiment shown, the fold line 23 comprises the bottom edge 25. Alternatively, two separate panel sections 16, 18 of polymeric film may be used and heat-sealed together along the two side edges 20, 22 and at the bottom edge 25. Access is provided to the interior 24 of the package 10 through a mouth 26 at the top edge 27 of the package. In the particular embodiment shown, the mouth 26 extends the width of the package 10.

A resealable closure mechanism 14 is illustrated in FIG. 1 at the mouth 26 of the flexible package 10. In the embodiment shown, the resealable closure mechanism 14 extends the width of the mouth 26. Alternatively, the closure mechanism 14 could be positioned on the package 10 at a location different from the mouth 26 of the package 10, depending on the application needs for the package 10. The resealable closure mechanism 14 can be one of a variety of closure mechanisms. In the particular embodiment illustrated in FIG. 2, the resealable closure mechanism 14 is shown in the specific form of a zipper-type closure mechanism. By the term "zipper-type closure mechanism," it is meant a structure having opposite interlocking or mating profiled elements that under the application of pressure will interlock and close the region between the profiles.

Figure 2:
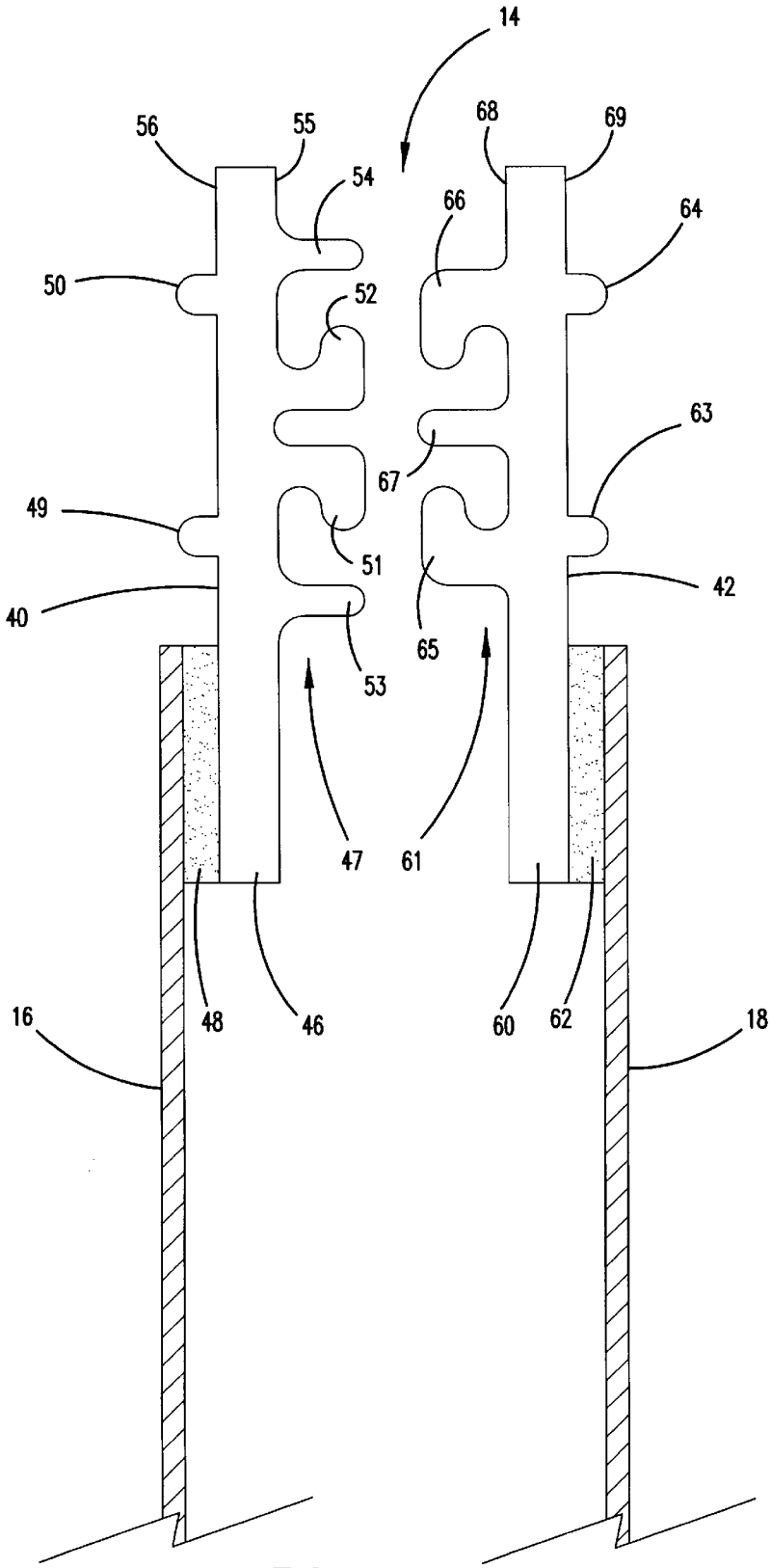
FIG. 2 is a fragmented, cross-sectional view of profiled elements secured to a flexible package, according to an example embodiment of the present invention.

Attention is directed to FIG. 2. FIG. 2 is an illustration of one example of a multi-track closure mechanism 14, for example, mating profile elements, that can be used with the present invention. By "multi-track," it is meant two or more pairs of interengaging hooks. The closure mechanism 14 includes an elongated first closure profile 40 and an elongated second closure profile 42. Typically, the closure profiles 40, 42 are manufactured separately from each other.

The first closure profile 40 includes a base strip 46, an interlocking closure member 47, a sealant layer 48, and two guide rails 49, 50. The interlocking closure member 47 has two interlocking closure flanges 51, 52 and two guide posts 53, 54. The sealant layer 48 is attached to a first panel section, such as the first panel section 16 of the package 10 of FIG. 1. The base strip 46 has an inner 55 and an outer surface 56. The outer surface 56 is attached to the sealant layer 48. The interlocking closure flanges 51, 52 extend out from the inner surface 55 of the base strip 46 and are generally projecting from the base strip 46. The guide posts 53, 54 also extend from the inner surface 55 and are generally projecting from the base strip 46. The guide rails 49, 50 extend from the outer surface 56 of the base strip 46 and are generally projecting from the base strip 46. The guide posts 53, 54 aid in holding the closure mechanism 14 closed and in aligning the first closure profile 40 with the second closure profile 42 for interlocking. Alternatively, the first closure profile 40 does not include a sealant layer 48. In this implementation, the outer surface 56 of the base strip 46 is attached directly to the first panel section 16 of the package 10 of FIG. 1.

The second closure profile 42 likewise includes a base strip 60, an interlocking closure member 61, a sealant layer 62, and two guide rails 63, 64. The interlocking closure member 61 has two interlocking closure flanges 65, 66 and a guide post 67. The sealant layer 62 is attached to a second panel section, such as the second panel section 18 of the package 10 of FIG. 1. The base strip 60 has an inner 68 and an outer surface 69. The outer surface 69 is attached to the sealant layer 62. The interlocking closure flanges 65, 66 extend from the inner surface 68 of the base strip 60 and are generally projecting from the base strip 60. The guide post 67 also extends from the inner surface 68 and is generally projecting from the base strip 60. The guide rails 63, 64 extend from the outer surface 69 of the base strip 60 and are generally projecting from the base strip 60. The guide post 67 aids in holding the closure mechanism 14 closed and in aligning the second closure profile 42 with the first closure profile 40 for interlocking. Alternatively, the second closure profile 42 does not include a sealant layer 62. In this implementation, the outer surface 69 of the base strip 60 is attached directly to the second panel section 18 of the package of FIG. 1.

The first and second closure profiles 40, 42 are designed to engage with one another to form a resealable closure mechanism 14. The interlocking closure flanges 51, 52 of the first closure profile 40 extend from the base strip 46 a certain distance. The interlocking closure flanges 65, 66 of the second closure profile 42 also extend from the base strip 60, a certain distance. These certain distances, that the interlocking closure flanges 51, 52, 65, 66 extend, are sufficient to allow mechanical engagement between the first interlocking closure flange 51 of the first closure profile 40 and the first interlocking closure flange 65 of the second closure profile 42. Likewise, the second interlocking closure flange 52 of the first closure profile 40 and the second interlocking closure flange 66 of the second closure profile 42 mechanically engage with each other. Furthermore, the closure profiles 40, 42 are sealed together at their ends, such as side edges 20, 22 of FIG. 1, to aid in aligning the closure profiles 40, 42 for interlocking. Pressure is applied to the closure profiles 40, 42 as they engage and form an openable sealed closure mechanism 14. Pulling the first closure profile 40 and the second closure profile 42 away from each other causes the two closure profiles 40, 42 to disengage, opening the package 10 of FIG. 1. This provides access to the contents of the package 10 through the mouth 26 (FIG. 1).

In some applications, the closure profiles 40, 42 are formed by two separate extrusions or through two separate openings of the common extrusion. Typically, the resealable closure mechanism 14 is made of a polymer, plastic material, such as polyethylene or polypropylene. In one example embodiment, the closure arrangement illustrated in FIG. 2 is manufactured using conventional extrusion and heat sealing techniques. In particular, the closure profiles 40, 42 are extruded through a die plate fed by a plurality of extruders. These extruders carry the molten materials for forming the closure profiles 40, 42. As is well known in the art, the die plate includes input ports, output ports, and channels connecting these input ports to output ports. The extruders feed the molten materials to different input ports, and the channels are designed to configure the molten materials into the shape of the closure profiles 40, 42. Typically, the sealant layers 48, 62 are extruded with the closure profiles 40, 42, respectively, such that the sealant layers 48, 62 are bonded to the respective outer surfaces 56, 69 of the base strips 46, 60 of the closure profiles 40, 42, respectively.

Figure 3:
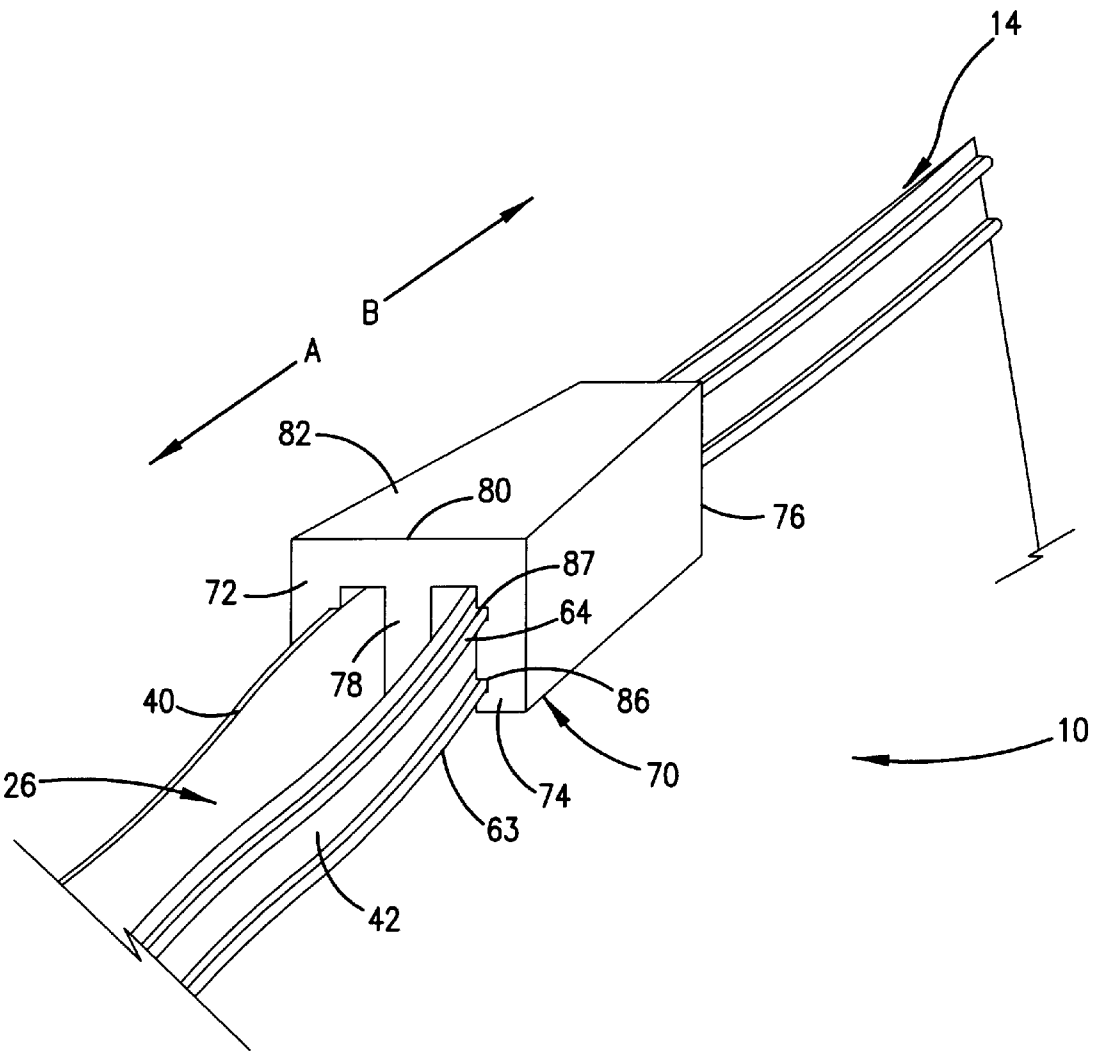
FIG. 3 is a fragmented, perspective view of an enlarged slider device engaging profiled elements, according to an example embodiment of the present invention.

Attention is directed to FIG. 3. A slider device 70 opens and closes the resealable closure mechanism 14. The slider device 70 has side walls 72, 74 and a first end 76. The side walls 72, 74 define a cavity that receives the first and second closure profiles 40, 42. The slider device 70 further has a separator or plow 78. The plow 78 extends down from the top 82 of the slider device 70 into the cavity. The plow 78 is located at a second end 80 of the slider device 70 and extends only partially along the length of the slider device 70. That is, the plow 78 only extends approximately 30 to 50% of the length of the slider device 70 beginning at the second end 80. The plow 78 does not exist at the first end 76 of the slider device 70. Confronting portions of the walls 72, 74 are tapered towards each other from the second end 80 towards the first end 76. Thus, when the slider device 70 is moved in a first, sealing direction A along the top edge 27 of the package 10, the tapered shapes of the side walls 72, 74 of the slider device 70 apply pressure to the closure profiles 40, 42, pinching them together behind the slider device 70 as the slider device 70 moves forward. Interlocking the closure profiles 40, 42 of the resealable closure mechanism 14 seals the mouth 26 of the package 10, preventing the contents of the package 10 from spilling out.

The plow 78 separates the closure profiles 40, 42 when the slider device 70 is moved in a second, opposite, opening direction B along the top edge 27 of the package 10. The plow 78 forces the closure profiles 40, 42 apart, providing access to the contents of the package 10 through the mouth 26. The closure profiles 40, 42, typically, are sealed together at a side edge, such as side edge 22 of the package 10 of FIG. 1. This side seal prevents the slider device 70 from traveling past the side edge 22 of the package 10 in the sealing direction A.

Figure 4:
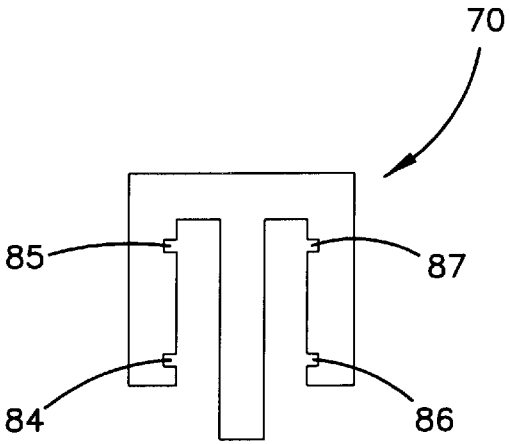
FIG. 4 is a front elevational view of the slider device of FIG. 3, according to an example embodiment of the present invention.

Attention is directed to FIG. 4. FIG. 4 is a front elevational view of the slider device 70 of FIG. 3. The slider device 70 has guide tracks 84, 85, 86, 87 positioned within the side walls 72, 74. The guide tracks 84, 85, 86, 87 are adapted to receive the guide rails 49, 50, 63, 64 (FIG. 2), respectively, of the first and second closure profiles 40, 42, respectively. The guide rails 49, 50, 63, 64 slide within the guide tracks 84, 85, 86, 87, respectively, to maintain the slider device 70 in its appropriate position along the closure profiles 40, 42. Referring back to FIG. 3, the guide rails 63, 64 of the second closure profile 42 are shown within the guide tracks 86, 87, respectively, of the slider device 70.

Referring back to FIG. 1, a slider housing 90 is shown extending beyond or out from the side edge 20 of the package 10. By "extending beyond," it is meant that the slider housing 90 is attached to the side edge 20 outside of the region of the package 10 defined by the side edges 20, 22, bottom edge 25, and the mouth 26.

Figure 5:
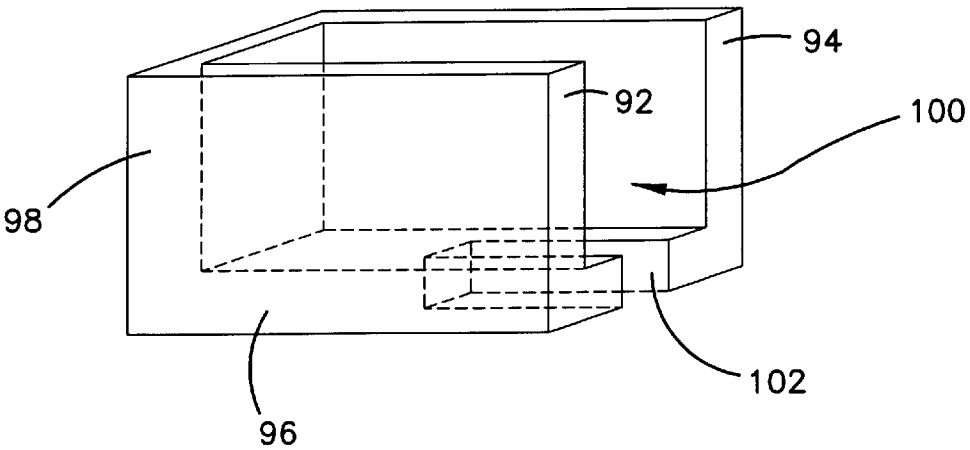
FIG. 5 is a perspective view of a slider housing, according to an example embodiment of the present invention.
Figure 6:
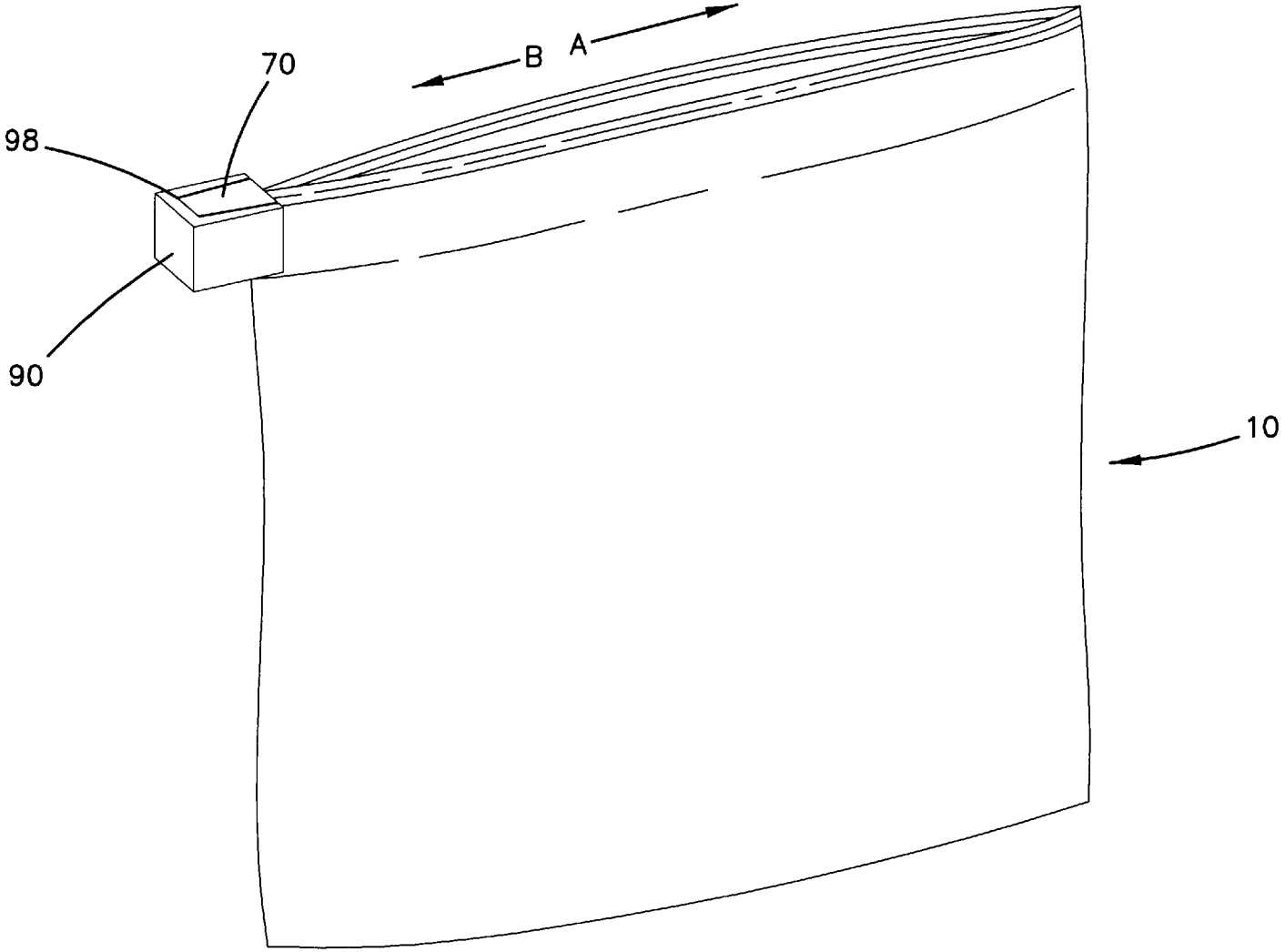
FIG. 6 is a perspective view of a flexible resealable package having the slider housing of FIG. 5 attached thereto, according to an example embodiment of the present invention.

Attention is directed to FIG. 5. The slider housing 90 is generally U-shaped with side walls 92, 94 and a bottom 96. The slider housing 90 also has a back wall 98. The side walls 92, 94, bottom 96, and the back wall 98 define a cavity 100. The cavity 100 is adapted to receive the slider device 70 (FIG. 3). Attention is directed to FIG. 6. In FIG. 6, the slider device 70 is shown within the cavity 100 of the slider housing 90. The back wall 98 serves as a stop, preventing the slider device 70 from traveling any further in the opening direction B.

Referring back to FIG. 5, the slider housing 90 also has a depending tab 102 that is used to attach the slider housing 90 to the package 10. The slider housing 90 is attached to the package 10 at a side edge, such as side edge 20 of package 10 of FIG. 1, and positioned in alignment with the closure profiles 40, 42 such that the guide rails 49, 50, 63, 64 (FIG. 2) of the first and second closure profiles 40, 42, respectively, align with the respective guide tracks 84, 85, 86, 87 (FIG. 4) of the slider device 70 when the slider device 70 is positioned within the slider housing 90 as shown in FIG. 6. The depending tab 102 is placed between the first and second closure profiles 40, 42 at the side edge 20 (FIG. 1) of the package 10. The depending tab 102 is then sealed into the closure mechanism 14 using a conventional crimp method or ultrasonic staking.

Referring back to FIG. 1, generally, to seal the package 10 a package user slides the slider device 70 in the sealing direction A across the top of the package 10. The tapered side walls 72, 74 (FIG. 3) apply pressure to the closure profiles 40, 42 interlocking them as the slider device 70 travels in the sealing direction A. The slider device 70 comes to rest against the side edge 22, sealing the mouth 26 of the package 10. Generally to open the package 10, the package user slides the slider device 70 in the opposite, opening direction B. The plow 78 (FIG. 3) separates the closure profiles 40, 42, opening the resealable closure mechanism 14. Referring back to FIG. 6, the slider device 70 is slid into the slider housing 90 and comes to rest against the back wall 98 of the slider housing 90. Because the slider device 70 is positioned beyond the side edge 20 of the package 10, access is gained to the contents of the package 10 through the entire width of the mouth 26 of the package 10.

Referring back to the FIG. 1, to reseal the package 10, the user slides the slider device 70 back in the sealing direction A as previously described. The guide rails 49, 50, 63, 64 (FIG. 2) fit within the respective guide tracks 84, 85, 86, 87 (FIG. 4) to appropriately position the slider device 70 along the closure profiles 40, 42. The plow 78 of the slider device 70 positions the slider device 70 between the closure profiles 40, The above specification and examples are believed to provide a complete description of the manufacture and use of particular embodiments of the invention. Many embodiments of the invention can be made without departing from the spirit and scope of the invention.

I claim:

1. A closure arrangement for use with a package having a plurality of edges, comprising:

(a) a first closure profile including a first base strip and a first interlocking closure member;

(b) a second closure profile including a second base strip and a second interlocking closure member;

(i) the first and second interlocking closure members arranged and configured to selectively engage;

(c) a slider device including a plow and first and second walls defining a first cavity for receiving the first and second closure profiles; the slider device being arranged and configured to:

(i) slide along the first and second closure profiles in a first direction to cause the first and second closure profiles to engage;

(ii) slide along the first and second closure profiles in a second direction to cause the first and second closure profiles to disengage; and (d) a slider housing for attachment to the package in a position extending beyond one of the plurality of edges of the package and adapted to receive the slider device.

2. A closure arrangement according to claim 1, wherein the first closure profile further includes a first plurality of guide rails extending from the first base strip.

3. A closure arrangement according to claim 2, wherein the second closure profile further includes a second plurality of guide rails extending from the second base strip.

4. A closure arrangement according to claim 3, wherein the slider device further includes a plurality of guide tracks positioned within the first and second walls for receiving the first and second plurality of guide rails of the first and second closure profiles.

5. A closure arrangement according to claim 4, wherein the slider housing includes first and second side walls, a back wall, and a bottom; the first and second side walls, the back wall, and the bottom defining a cavity for receiving the slider device.

6. A closure arrangement according to claim 5, wherein the slider housing further includes a depending tab adapted for attachment to the package.

7. A closure arrangement according to claim 1, wherein the first interlocking closure member comprises first and second guide posts extending from the first base strip, and first and second interlocking closure flanges extending from the first base strip.

8. A closure arrangement according to claim 7, wherein the second interlocking closure member comprises a third guide post extending from the second base strip, and third and fourth interlocking closure flanges extending from the second base strip.

9. A closure arrangement according to claim 8, wherein the third and fourth interlocking closure flanges of the second closure profile are arranged and configured to selectively engage with the first and second interlocking closure flanges of the first closure profile.

10. A closure arrangement according to claim 9, wherein the first closure profile further includes a first sealant layer attached to the first base strip; the first sealant layer adapted for attachment to the package.

11. A closure arrangement according to claim 10, wherein the second closure profile further includes a second sealant layer attached to the second base strip; the second sealant layer adapted for attachment to the package.

12. A closure arrangement according to claim 1, wherein the first and second closure profiles comprise a polymer material.

13. A closure arrangement according to claim 12, wherein the first and second closure profiles comprise polypropylene or polyethylene.

14. A resealable package comprising:

(a) first and second panel sections joined together to define an enclosed region; first and second opposite side edges; a top edge; and a mouth providing access to the enclosed region; and (b) a closure arrangement secured to the first and second panel sections for selectively opening and sealing the mouth; the closure arrangement including:

(i) a first closure profile including a first base strip and a first interlocking closure member;

(ii) a second closure profile including a second base strip and a second interlocking closure member;

(A) the first and second interlocking closure members arranged and configured to selectively engage;

(iii) a slider device including a plow and first and second walls defining a first cavity for receiving the first and second closure profiles; the slider device being arranged and configured to:

(A) slide along the first and second closure profiles in a first direction to cause the first and second closure profiles to engage;

(B) slide along the first and second closure profiles in a second direction to cause the first and second closure profiles to disengage; and (iv) a slider housing extending beyond a side edge of the package and adapted to receive the slider device.

15. A resealable package according to claim 14, wherein the first closure profile further includes a first plurality of guide rails extending from the first base strip.

16. A resealable package according to claim 15, wherein the second closure profile further includes a second plurality of guide rails extending from the second base strip.

17. A resealable package according to claim 16, wherein the slider device further includes a plurality of guide tracks positioned within the first and second walls for receiving the first and second plurality of guide rails of the first and second closure profiles.

18. A resealable package according to claim 17, wherein the slider housing includes first and second side walls, a back wall, and a bottom; the first and second side walls, the back wall, and the bottom defining a cavity for receiving the slider device.

19. A resealable package according to claim 18, wherein the slider housing further includes a depending tab adapted for attachment to the package.

20. A method of manufacturing a resealable package having first and second opposing panel sections, the method comprising the steps of:

(a) placing the first panel section adjacent to the second panel section;

(b) placing a closure arrangement between an unsealed edge of the first panel section and a corresponding unsealed edge of the second panel section, the closure arrangement including:

(i) a first closure profile having a first base strip and a first interlocking closure member;

(ii) a second closure profile having a second base strip and a second interlocking closure member;

(A) the first and second interlocking closure members arranged and configured to selectively engage;

(iii) a slider device having a plow and first and second walls defining a first cavity for receiving the first and second closure profiles; the slider device being arranged and configured to:

(A) slide along the first and second closure profiles in a first direction to cause the first and second closure profiles to engage;

(B) slide along the first and second closure profiles in a second direction to cause the first and second closure profiles to disengage;

(iv) a slider housing extending beyond a side edge of the package and adapted to receive the slider device;

(c) sealing a plurality of edges of the first panel section to corresponding edges of the second panel section; and (d) securing the closure arrangement to the first and second panel sections.

21. A method of manufacturing a resealable package according to claim 20, wherein the step of placing a closure arrangement includes the slider housing having first and second side walls, a back wall, a bottom, and a depending tab; the first and second side walls, the back wall, and the bottom defining a cavity for receiving the slider device.

22. A method of manufacturing a resealable package according to claim 21, wherein the step of placing a closure arrangement includes placing the depending tab of the slider housing between the first and second closure profiles.

23. A method of manufacturing a resealable package according to claim 22, wherein the step of securing includes securing the first closure profile to the first panel section, and securing the second closure profile to the second panel section.

24. A method of manufacturing a resealable package according to claim 23, wherein:

(a) the step of securing the first closure profile to the first panel section includes bonding the first closure profile to the first panel section with a first sealant layer; and (b) the step of securing the second closure profile to the second panel section includes bonding the second closure profile to the second panel section with a second sealant layer.

25. A method of manufacturing a resealable package according to claim 20, wherein the step of securing the resealable closure mechanism includes securing the slider housing to one of the plurality of sealed edges of the package using crimping.

26. A method of manufacturing a resealable package according to claim 20, wherein the step of securing the resealable closure mechanism includes securing the slider housing to one of the plurality of sealed edges of the package using ultrasonic staking.

27. A method of opening a resealable package comprising the steps of:

(a) providing a package having first and second opposite side edges; a resealable mouth having a width extending between the first and second side edges; a resealable closure mechanism and a slider device thereover for opening and resealing the mouth; and a slider housing extending beyond a side edge of the package adapted for receiving the slider device; the closure mechanism including first and second opposed selectively interlocking profiles;

(b) moving the slider device along the mouth from the second edge to the first edge to disengage the first and second profiles; and (c) moving the slider device into the slider housing providing access across the entire width of the mouth of the package.

* * * * *